United States Patent [19]

Dörflinger et al.

[11] Patent Number: 4,603,913

[45] Date of Patent: Aug. 5, 1986

[54] APPARATUS FOR STORING AND MANIPULATING BUNDLES OF BRISTLES IN BRUSH MAKING MACHINES

[75] Inventors: Benno Dörflinger; Walter Steinebrunner, both of Todtnau, Fed. Rep. of Germany

[73] Assignee: Anton Zahoransky, Todtnau, Fed. Rep. of Germany

[21] Appl. No.: 691,897

[22] Filed: Jan. 16, 1985

[30] Foreign Application Priority Data

Jan. 21, 1984 [DE] Fed. Rep. of Germany ..... 3402051

[51] Int. Cl.[4] ..... A46D 1/04

[52] U.S. Cl. ..... 300/7

[58] Field of Search ..... 198/646; 414/418, 425; 53/537, 543; 300/4, 5, 6, 7, 18, 19, 21

[56] References Cited

U.S. PATENT DOCUMENTS

| | | | |
|---|---|---|---|
| 1,810,645 | 6/1931 | Dieter | 198/646 X |
| 2,356,121 | 8/1944 | Cave et al. | 300/7 |
| 2,893,594 | 7/1959 | Burt et al. | 414/418 X |
| 4,111,491 | 9/1978 | Steinebrunner et al. | 300/21 |

FOREIGN PATENT DOCUMENTS 2643222 4/1978 Fed. Rep. of Germany .

*Primary Examiner*—Mark Rosenbaum

*Attorney, Agent, or Firm*—Peter K. Kontler

[57] ABSTRACT

Apparatus for storing and manipulating bundles of partially wrapped batches of bristles in a brush making machine has a single plate-like support or two or more stationary or mobile supports for temporary storage of bundles. The support or supports can admit bundles into the range of a singularizing device which delivers discrete bundles to an opening station where the bundles are relieved of their wrappers prior to introduction of the thus exposed batches of bristles into the magazine or magazines of the brush making machine. Mobile supports can constitute pallets which are transported by a conveyor into the range of a chute serving to advance bundles from successive loaded pallets into the range of the singularizing device. The apparatus can store a supply of bundled bristles which suffices to satisfy the requirements of the machine during an entire shift. The supports can be stored side by side or one above the other, depending upon the availability of space in the brush making plant.

26 Claims, 14 Drawing Figures

Fig. 2

22
19
19a
5
5
4
3
8
39
7
2
18
19a
5
5
III
10
21
14
III
5
22
11
6
13
19
5
17
10
13
11
14
5
20
14
5
11
13
10
DD
SD
FD

1

Fig. 4
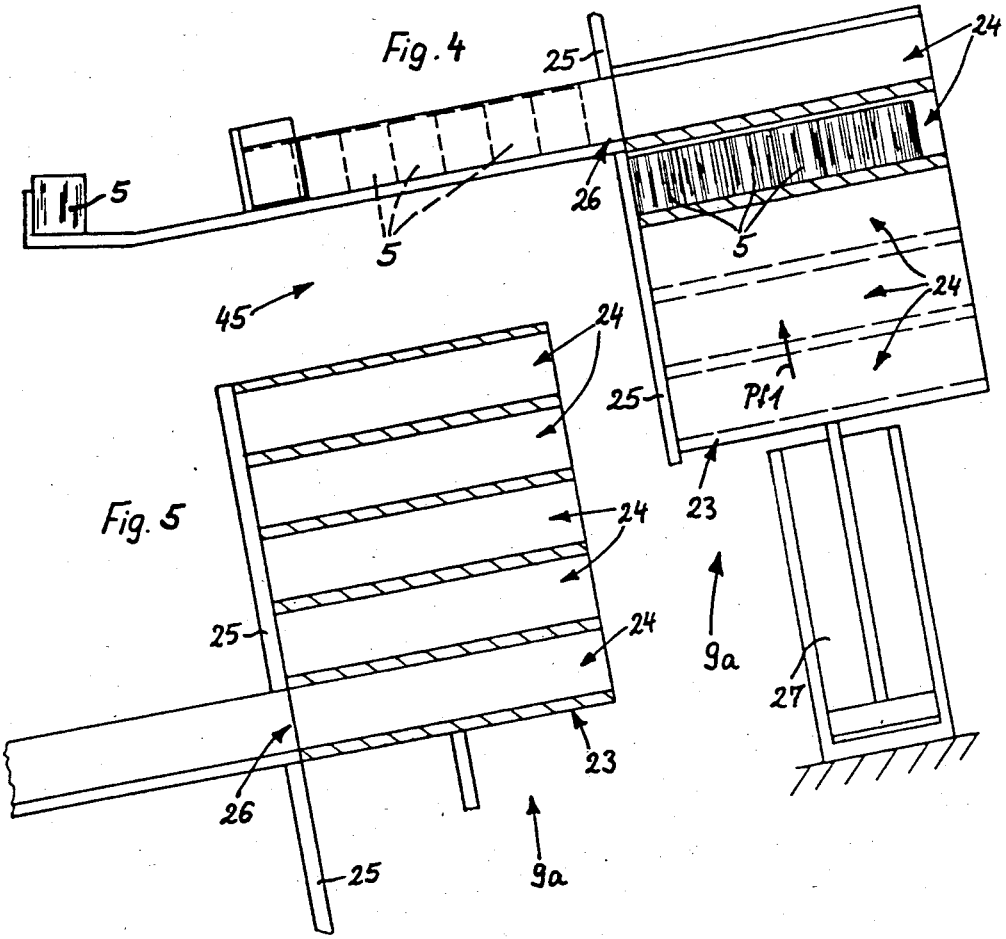
Fig. 5
Fig. 7
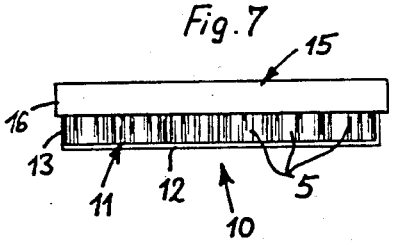
Fig. 6
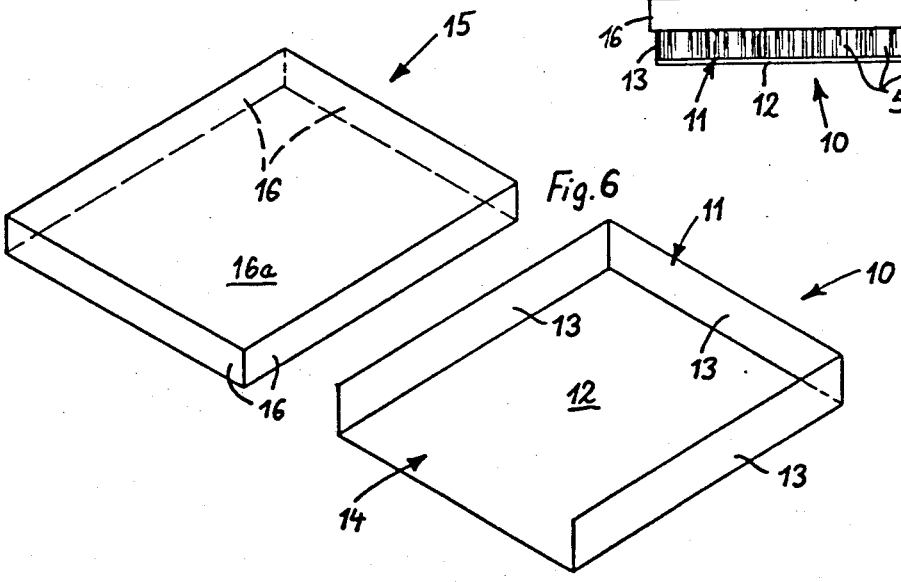

40
29
5
19a
5
22
28
6
31
30
5
5
28
5
5
40
22
30
19a
17
29

APPARATUS FOR STORING AND MANIPULATING BUNDLES OF BRISTLES IN BRUSH MAKING MACHINES

CROSS-REFERENCE TO RELATED CASE

Certain details of the machine which embodies the apparatus of the present invention are disclosed in the commonly owned copending patent application Ser. No. 672,100 filed Nov. 15, 1984 by Walter Steinebrunner for "Method and apparatus for replenishing the supplies of bristles in the magazines of brush making machines".

BACKGROUND OF THE INVENTION

The present invention relates to brush making machines in general, for example, to brush making machines of the type disclosed in commonly owned U.S. Pat. No. 4,111,491, and more particularly to improvements in apparatus for storing and manipulating bundles which contain batches of wrapped bristles preparatory to opening of the bundles and the admission of the thus exposed batches into a magazine.

It is well known to store a supply of parallel bristles in a magazine whose open end is adjacent to a transfer member serving to gather tufts of bristles and to transfer such tufts to an inserting station where the tufts are implanted in the body of a brush. In many presently known brush making machines, the supply of bristles in the magazine is replenished by hand. Relatively long bundles, each of which contains a batch of parallel bristles within the confines of a suitable envelope, are cut to length (i.e., subdivided into a plurality of shorter bundles) and the thus obtained short or relatively short bundles are temporarily stored in cartons or other types of receptacles. The cartons are transferred to the magazine and their contents are removed when necessary, the removed bundles are relieved of their wrappers, and the thus obtained batches of exposed parallel bristles are inserted into the magazine. The just described procedure of manually feeding batches of bristles into a magazine is time-consuming, complex, tiresome and expensive. Moreover, the operation of the tuft forming and transferring tool must be interrupted whenever the attendant inserts a fresh batch into the magazine. Unless the bundles are very large, the supply of bristles in the magazine must be replenished at frequent intervals so that the sum total of down times is quite substantial and the output of the brush making machine is low. While it is conceivable to enlarge the magazine so that the latter can store a relatively large supply of bristles, the dimensions of the magazine cannot be increased at will because this could affect the accuracy with which the bristles are stored therein and hence the accuracy of the formation of tufts. The bristles in the magazine cannot be compacted with a substantial force because this would prevent the transfer member from gathering acceptable tufts, i.e., this would adversely influence the quality of the ultimate products. It has been found that proper orientation and the absence of excessive compacting of bristles in the magazine can be ensured only if the magazine is relatively small so that the mutual positions of bristles can be adequately controlled in each and every portion of the magazine.

Published European patent application No. 0 034 866 discloses an apparatus which is designed to supply bristles to the tuft gathering station of a brush making machine. Such station is defined by a magazine which comprises several compartments for loose bristles. The apparatus of this printed publication is quite complex, bulky and expensive. Moreover, the orientation of bristles in the compartments of the magazine is not entirely satisfactory and the introduction of bristles into as well as their evacuation from such compartments is problematic.

German Offenlegungsschrift No. 26 43 222 discloses a brush making machine wherein the delivery of batches of bristles to the magazine is automated. Bundles of batches of bristles in suitable envelopes are delivered to an opening station which is adjacent to the magazine and which can admit batches (e.g., by gravity) into the inlet of the magazine so that the admitted batches can be engaged and compacted by mobile tamping instrumentalities. The bundle supplying apparatus of the machine which is disclosed in this German printed publication is rather complex and its capacity is limited. Moreover, the reliability of the apparatus is not sufficiently high.

OBJECTS AND SUMMARY OF THE INVENTION

An object of the invention is to provide a novel and improved apparatus which can supply batches of bristles to the magazine of a brush making machine for any desired interval of time in a fully automatic way and with a high degree of reliability.

Another object of the invention is to provide an apparatus which can supply batches of bristles into the magazines of existing brush making machines.

A further object of the invention is to provide the apparatus with novel and improved supporting, transporting and singularizing means for bundles of wrapped batches of parallel bristles.

An additional object of the invention is to provide an apparatus which can be used for storage and manipulation of short, long, lightweight or heavy bundles with the same degree of facility, reliability and predictability.

Still another object of the invention is to provide a novel and improved method of storing and dispensing discrete bundles of wrapped batches of metallic, plastic or other types of bristles preparatory to conversion of such batches into tufts which are inserted into the bodies of successive brushes.

A further object of the invention is to provide a novel and improved reservoir for smaller or larger accumulations of bundles of wrapped bristles.

Another object of the invention is to provide a brush making machine which cooperates with or embodies the above outlined apparatus.

An additional object of the invention is a simple, compact, relatively inexpensive but rugged, reliable and easy-to-operate apparatus for delivery of bundles of bristles to the magazine of a brush making machine.

Another object of the invention is to provide the apparatus with novel and improved mobile supports for groups of bundles each of which contains a batch of draped parallel bristles.

The invention resides in the provision of an apparatus which serves to store bundles of wrapped batches of bristles and to deliver batches to one or more magazines of a brush making machine wherein the bristles are confined for transfer to the brush making station and the supply of bristles in each magazine must be replenished at intervals by the admission of batches of arrayed (normally parallel) bristles. The apparatus comprises a source of bundles preferably including one or more substantially plate-like supports for sets of neighboring bundles, and means for receiving bundles from the source. Such receiving means comprises or cooperates with means for unwrapping the batches and for admitting the batches into the magazine or magazines of the brush making machine. For example, the receiving means can comprise a singularizing device which serves to accept discrete (individual) bundles from the source. Each support preferably comprises means for carrying a set of several adjacent regular or irregular rows of neighboring bundles, e.g., several parallel rows or rows in the so-called quincunx formation. Each support can comprise or constitute a pallet and the source can further comprise conveyor means (e.g., one or more belt or chain conveyors) for transporting successive loaded pallets to a predetermined position in the range of the receiving means, e.g., in the range of the aforementioned singularizing device so that the latter can receive one bundle after the other for delivery to an opening unit where the bundles are relieved of their wrappers (i.e., where the batches are exposed) prior to introduction into the magazine or magazines of the brush making machine. Each pallet can comprise a bundle-supporting bottom panel and sidewalls extending upwardly from the bottom panel and defining at least one opening for evacuation or discharge of bundles which rest on the bottom panel. The bottom panel and its sidewalls can constitute a first section or component of each pallet, and each pallet can further comprise a cover or lid which overlies the bundles on the respective bottom panel and has sidewalls which overlie the sidewalls of the respective first section. The pallets are preferably separable (i.e., detachable) from the conveyor means so that they can be loaded with fresh sets of bundles at a location which is remote from the conveyor means.

The conveyor means can deliver successive loaded pallets to the upper end of a chute which forms part of the source and serves to deliver the bundles into the range of the receiving means, e.g., into the range of the aforementioned singularizing device. Alternatively, the chute can be designed to receive bundles from successive pallets or otherwise configurated supports which are not supported by conveyor means or which are supported by conveyor means in the form of an elevator conveyor for a reservoir with several storeys each of which can accommodate one or more supports. If the source comprises belt or chain conveyor means which defines a first path, the chute of the source preferably defines a second path which extends transversely of the first path and slopes downwardly toward the singularizing device or devices of the receiving means. If the source comprises a multi-storey reservoir for loaded and empty supports, it preferably further comprises means (e.g., one or more fluid-operated cylinder and piston units) for moving any one of the storeys to a predetermined level which is best suited (or which alone is suited) for the delivery of bundles into the range of the receiving means, e.g., by way of the aforementioned chute or chutes. The multi-storey reservoir can be mounted on supported in such a way that the supports therein slope in a predetermined direction; each support has an opening or outlet for discharging discrete bundles or larger groups of bundles into the range of the receiving means. The source can further comprise guide means which is adjacent to the path of movement of supports, especially if the supports slope to facilitate the evacuation of bundles by gravity, and which serves to prevent the evacuation of bundles from the supports while the supports are in the process of advancing into the range of the receiving means. Such guide means can comprise a stationary wall with an opening in register with the opening of that support which is ready for the evacuation of its contents. A chute or the like can be provided to transport discrete bundles or larger groups of bundles from the opening of the stationary wall to the receiving means.

The means for delivering bundles to the support or supports of the source can comprise a suitable conveyor for the delivery of files of coherent bundles, means for subdividing each such file into a plurality of discrete bundles, and means for depositing the thus obtained discrete bundles on the support or supports of the source. The aforementioned means for removing wrappers (i.e., for unwrapping the batches of bristles) is preferably disposed between the receiving means and the magazine or magazines of the brush making machine, or such unwrapping means can constitute a component part of or the entire receiving means.

The singularizing device preferably comprises a reciprocable singularizing member with a pocket which can receive one bundle at a time and means for reciprocating the singularizing member along a predetermined path in a first portion of which the pocket can receive a fresh bundle and in a second portion of which the contents of the pocket can be removed mechanically, by gravity or in another suitable way. The pocket can deliver discrete batches to the means for unwrapping the batches of bristles which form part of such bundles, and the unwrapping means can be designed to receive a single bundle at a time.

If the brush making machine has several magazines, the source of bundles can be provided with several outlets, one for each magazine of the brush making machine. The receiving means then preferably comprises a discrete receiving unit for each outlet of the source and each discrete receiving unit can be arranged to receive bundles from the respective outlet and to deliver, or to prepare for delivery, the bristles of the thus received bundles to the corresponding magazine of the brush making machine.

For example, the source can be provided with several outlets for discrete bundles (each outlet can deliver bundles containing a certain type of bristles) and the receiving means can comprise a discrete bundle advancing unit, one for each outlet of the source, and a chute or other suitable means for accepting bundles from such units. For example, the outlets of the source can deliver bundles into first paths, the advancing means can deliver bundles from such first paths into a further path, and the accepting means can comprise means for advancing bundles along the further path, e.g., into the range of a single unwrapping device.

The support or supports can carry the bundles in at least substantially upright position. If the bundles are cylinders, one end of each cylinder preferably rests on the respective support. Each support can further comprise a barrier (e.g., one sidewall of the aforementioned bottom panel forming part of a pallet-shaped support) which is adjacent to one marginal portion of the support (namely to the lowermost portion if the support is inclined) and serves to constitute an abutment for the adjacent bundles on the respective support.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 4 is a schematic partly elevational and partly vertical sectional view of a third apparatus which can store groups of bundles in the compartments of a multistorey reservoir designed to discharge bundles by gravity feed;

FIG. 5 illustrates the reservoir of FIG. 4 in its upper end position in which the lowermost compartment of the reservoir is in the required position for the transfer of its contents onto the upper side of a chute serving to deliver bundles to the receiving means;

FIG. 6 is a perspective view of the two sections of a pallet-like support which can be used in the apparatus of FIG. 2 or in the apparatus of FIG. 4;

FIG. 7 is a side elevational view of a pallet in assembled condition with a group of bundles between its upper and lower sections;

DESCRIPTION OF THE PREFERRED EMBODIMENTS

Figures 2, 3:
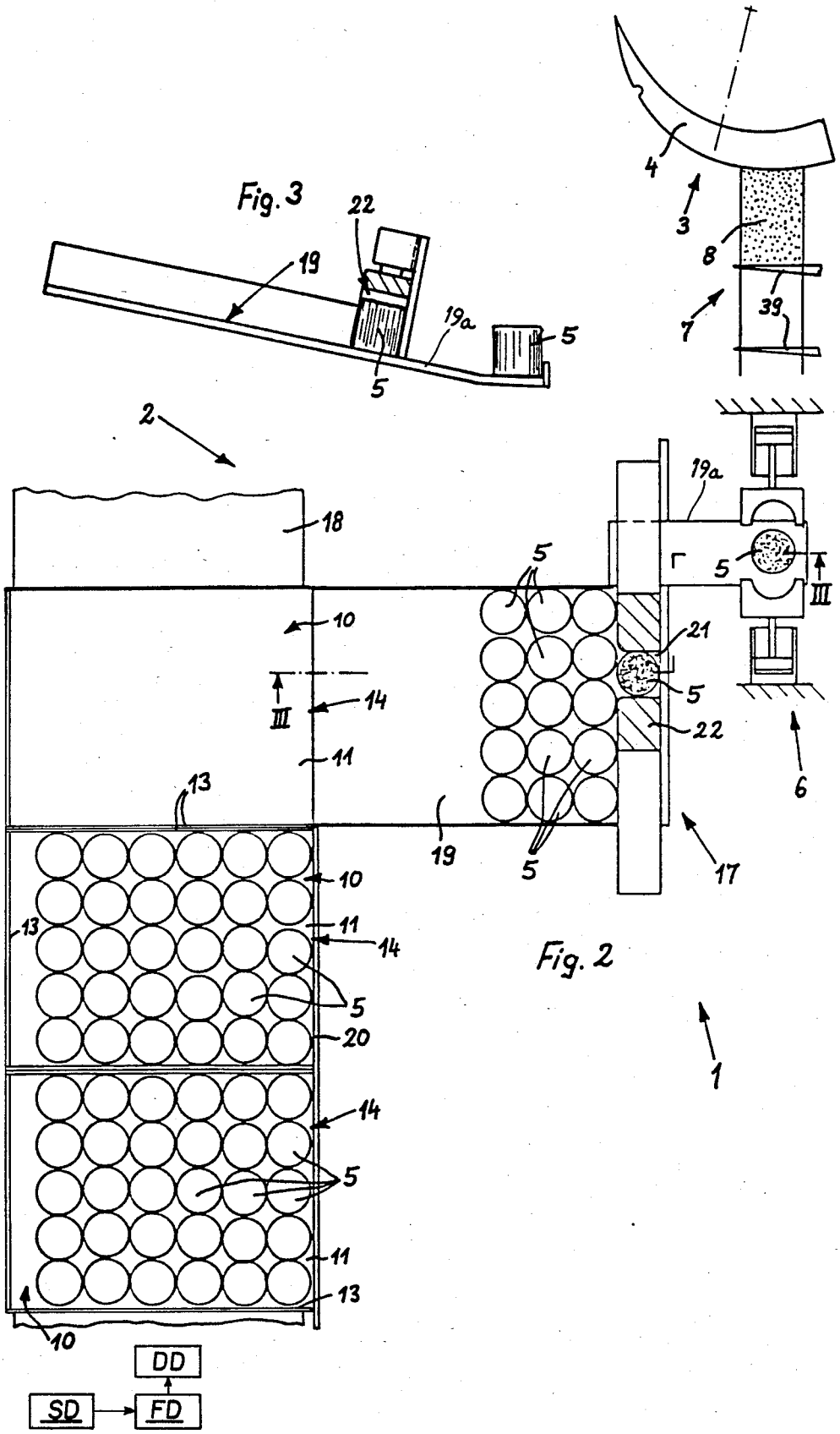
FIG. 2 is a fragmentary schematic plan view of a second brush making machine with a modified apparatus wherein the source of bundles comprises a plurality of two-piece pallets each of which can store a group of bundles and each of which can be detached from its conveyor.
FIG. 3 is a sectional view as seen in the direction of arrows from the line III—III of FIG. 2.
Figure 10:
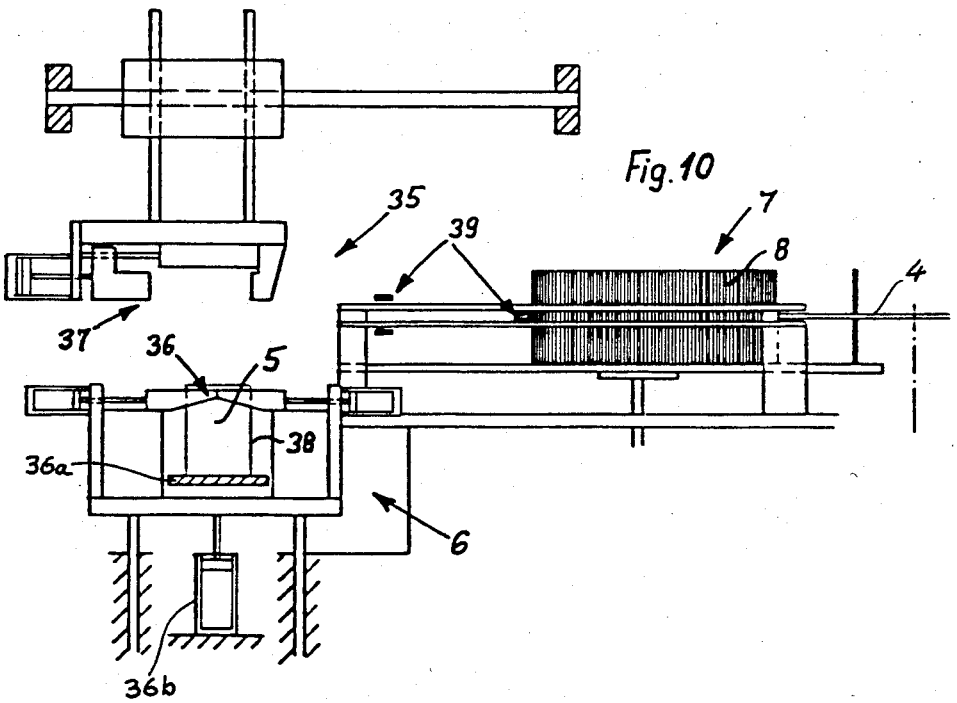
FIG. 10 is an elevational view of the magazine of a brush making machine and of the means for opening successive bundles and for transferring the thus exposed batches of bristles into the magazine.

Referring first to FIG. 2, thereis shown a portion of a brush making machine 1 including an apparatus which embodies one form of the invention. The apparatus comprises a source 2 of bundles 5 each of which includes a batch of parallel bristles 8 surrounded by a suitable envelope or wrapper 38 (FIG. 10). Each bundle 5 is a relatively short or a relatively long cylinder, depending on the length of the respective bristles 8, and is stored in the source 2 in upright or substantially upright position. The reference character 3 denotes in FIG. 2 the tuft forming and transferring station for a substantially sickle-shaped transfer member 4 which receives one or more tufts of bristles 8 from a magazine 7 during each passage of its non-referenced notch along the front side of the magazine 7. The latter cooperates with two tamping members 39 which can be constructed, mounted and operated in a manner as disclosed in commonly owned U.S. Pat. No. 4,111,491. This patent also describes the function and the mode of operation of the transfer member 4.

The source 2 comprises a plurality of mobile supports in the form of pallets 10 each of which can be constructed in a manner as shown in FIG. 6. FIG. 2 merely shows the first or lower sections 11 of a total of three pallets 10 on the upper reach of a belt or band conveyor 18. The latter advances successive loaded pallets 10 to a predetermined position at the upper end of an elongated chute 19 (see also FIG. 3) which delivers the contents of successive pallets 10 into the range of a receiving means here shown as including a singularizing device 17 with a reciprocable singularizing member 22 having a pocket 21 for reception of one bundle 5 at a time. The means for reciprocating the singularizing member 22 can comprise a fluid-operated motor of the type disclosed in the commonly owned copending application Ser. No. 672,100. The chute 19 has an extension **19*a* which receives a discrete bundle 5 from the pocket 21 whenever the singularizing member 22 reaches its upper end position, as viewed in FIG. 2, and the extension 19*a* delivers the freshly received bundle 5 into an opening or unwrapping device at an opening station 6 between the receiving means (singularizing device 17) and the magazine 7 of the brush making machine 1. The manner in which the device at the station 6 removes wrappers 38 from batches forming part of the bundles 5 which are delivered by the extension 19*a* of the chute 19 is or can be the same as disclosed in the copending application Ser. No. 672,100. The manner in which the thus exposed batches of bristles are transferred into the magazine 7 is or can be the same as disclosed in U.S. Pat. No. 4,111,491. The contents (parallel bristles) of batches which are delivered into the magazine 7 are condensed by the tamping members 39 to thus ensure that the transfer member 4 can accumulate tufts of optimum consistency for transfer to the tuft inserting and anchoring station where such tufts are implanted in the body of a brush, not shown. The tamping action is adjustable in a manner not forming part of the present invention to ensure that the bristles 8 in the magazine 7** are sufficiently loose for the formation of acceptable tufts but are sufficiently close to each other to ensure that they retain their optimum orientation.

As a rule, the supply of bristles 8 in the magazine 7 is relatively small for reasons which were explained hereinbefore. Thus, a relatively small magazine 7 renders it possible to accumulate and maintain therein a small supply of relatively loose bristles 8 which are parallel to each other and can be readily moved forwardly toward the transfer member 4 for conversion into tufts which are then delivered to the inserting station.

The source 2 preferably accommodates a substantial number of bundles 5 so that the operation of the brush making machine 1 need not be interrupted on account of the absence of fresh bundles 5 and batches of parallel bristles 8. For example, the source 2 can contain a supply of bundles 5 which suffices to satisfy the requirements of the brush making machine 1 during an entire shift. The accumulation of a relatively large number of bundles 5 close or relatively close to the receiving means (singularizing device 17), opening station 6 and magazine 7 presents no problems since the bristles in the batches 5 are adequately confined in a suitable wrapping material so that proper orientation of each batch during storage ahead of and during delivery to the opening station 6 presents no problems at all.

Loaded pallets 10 can be deposited onto the upper reach of the conveyor 18 at a location below the lowermost pallet 10 (as viewed in FIG. 2, and the conveyor 18 is operated intermittently to advance successive foremost pallets 10 to the predetermined position at the upper end of the chute 19. Successive empty pallets 10 can be lifted off the conveyor 18 downstream of the upper end of the chute 19, as considered in the direction of movement of the upper reach of the conveyor 18, and the bundles 5 which are permitted to leave their pallet 10 then advance along a second path (defined by the chute 19) which extends transversely of the path of movement of pallets with the upper reach of the conveyor 18.

As can be best seen in FIGS. 2 and 6, each pallet 10 comprises a lower or first section 11 having a bottom panel or wall 12 which can carry a series of rows of neighboring bundles 5, and three sidewalls 13 which extend upwardly from the bottom panel 12 and define an elongated opening or outlet 14 for evacuation of bundles 5 which rest on the bottom panel 12. The second or upper section 15 of each pallet 10 comprises a cover or lid **16*a* with four downwardly extending sidewalls 16 which overlie the sidewalls 13 of the respective lower section 11 as well as at least a portion of the respective opening 14 (see FIG. 7) to prevent accidental or unintentional evacuation of bundles 5 from the space above the bottom panel 12. The second sections 15 of the pallets 10 prevent contamination of the bristles 8, especially in the regions of the upper end faces of the respective bundles 5. In many instances, the ends of the bristles at the upper end faces of the bundles 5 are not concealed because such bundles are or can be obtained by subdividing files of coherent coaxial bundles into bundles of requisite length. Such subdivision involves severing the wrappers of the files of coaxial bundles at regular intervals with the result that the peripheries of the batches of bristles 8 in the bundles 5 on the bottom panels 12 of the pallets 10 are still confined but the ends of the bristles are exposed at one or both ends of each bundle 5. The provision of second sections 15 exhibits the additional advantage that empty or loaded pallets 10 can be readily stacked on top of each other. The dimensions of the pallets 10 are preferably selected in such a way that the weight of loaded pallets is not excessive. This is desirable and advantageous if loaded pallets 10 are to be placed onto the conveyor 18 by hand and/or if empty pallets (actually the lower sections 11 of such pallets) are manually removed from the conveyor 18 downstream of the station at the upper end of the chute 19. The pallets 10 need not even be secured to the upper reach of the conveyor 18 if such upper reach is horizontal or substantially horizontal. At any rate, the pallets 10 are readily detachable from the conveyor 18 so that they can be reloaded and returned onto the upper reach of the conveyor 18 for repeated delivery to the station at the upper end of the chute 19. The improved apparatus can further comprise means for automatically filling empty pallets 10, for automatically depositing loaded pallets on the conveyor 18, for automatically removing empty pallets from the conveyor 18 and/or for automatically returning empty pallets from the conveyor 18 to the filling means. This depends on the desired degree of automation. FIG. 2 shows schematically an automatic subdividing or severing device SD which can subdivide elongated bundles into shorter bundles 5, an automatic filling or loading device FD which can fill empty pallets 10 with bundles 5, and an automatic depositing device DD which serves to deposit loaded pallets 10 onto the upper reach of the conveyor 18**. The exact design of such devices forms no part of the present invention.

FIG. 2 further shows a stationary guide wall or barrier 20 which forms part of the source 2 and is adjacent to the openings 14 of lower sections 11 of loaded pallets 10 on the upper reach of the conveyor 18. The barrier 20 renders it possible to remove the upper sections 15 from the respective lower sections 11 ahead of the upper end of the chute 19 so that the contents of successive lower sections 11 can be transferred onto the chute 19 by gravity if the upper reach of the conveyor 18 slopes downwardly in a direction from the left to the right, as viewed in FIG. 2, in order to promote gravitational delivery of bundles 5 from the bottom panels 12 of successive lower sections 11 onto the upper side of the chute 19. The barrier 20 terminates at the upper end of the chute 19 so that it cannot interfere with the transfer of bundles 5 from the bottom panels 12 of successive lower sections 11 onto the chute 19 and the advancement of such bundles toward the receiving means (singularizing device) 17.

The length of the upper reach of the conveyor 18 (which can be replaced with a chain conveyor or with several discrete belt conveyors without departing from the spirit of the invention) can be selected practically at will and is dependent exclusively or nearly exclusively on the availability of space in the brush making plant. A relatively long conveyor 18 will ensure that its upper reach can receive a substantial number of loaded pallets 10 so that the replenishment of pallets can take place at infrequent intervals. As mentioned above, the source 2 can be designed to store a supply of bundles 5 which suffices for an entire shift.

The apparatus including the source 2 of FIG. 2 can be modified in a number of ways. For example, the chute 19, **19*a* (or at least the major part of this chute) can be omitted if the upper reach of the conveyor 18 slopes downwardly in a direction from the left to the right and to an extent which suffices to ensure automatic gravitational descent of bundles 5 from the bottom panel 12 of the foremost loaded lower section 11 toward the pocket 21 in the reciprocable singularizing member 22 of the receiving means 17. In other words, the openings 14 of successive sections 11 can be advanced into immediate or close proximity of the singularizing member 22**.

Figure 1:
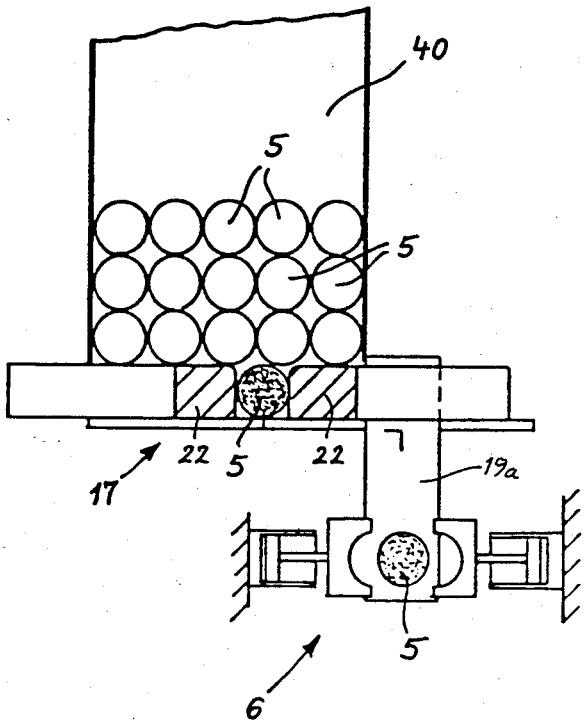
FIG. 1 is a fragmentary plan view of a brush making machine which embodies one form of the improved apparatus with a single stationary support for a supply of bundled bristles, a portion of the receiving means for discrete bundles of bristles being shown in a horizontal sectional view.

FIG. 1 illustrates a portion of a modified apparatus which is somewhat similar to the just described modified version of the apparatus shown in FIG. 2. The reference character 40 denotes a stationary or mobile substantially plate-like support which is used in lieu of pallets 10 and slopes downwardly toward the respective side of the reciprocable singularizing member 22 of the receiving means 17 for discrete bundles 5. The part **19*a* can constitute a chute or another type of conveyor which delivers successive singularized bundles 5 to the opening station 6** where the bundles are relieved of their wrappers preparatory to the admission of the thus exposed batches of bristles into the magazine of the brush making machine.

At least the lower portion of the support 40 of FIG. 1 can be bounded by stationary sidewalls or barriers to ensure that the upper side of the support 40 can carry neatly arrayed rows of closely adjacent bundles 5. The stroke of the singularizing member 22 is sufficient to ensure that this member can move its pocket into register with each of the bundles 5 of the foremost (lowermost) row of bundles on the upper side of the support 40.

The dimensions of the support 40 can be selected with a view to store thereon a requisite supply of bundles 5. If desired, the support 40 can constitute one of a battery of supports which can be moved next to the receiving means 17 for the transfer of bundles thereon into the pocket of the singularizing member 22. The unwrapping means at the opening station 6 can be of the type shown in FIG. 9.

FIGS. 4 and 5 illustrate a modified apparatus with a multi-storey magazine or reservoir 9*a* and a conveyor 27 (e.g., a double-acting fluid-operated cylinder and piston unit) for moving any one of the several storeys to a predetermined level, namely to the level of the upper end of a chute 45 resembling the chute 19 of FIG. 2. The bottom wall 23 of the reservoir 9*a* is connected to the piston rod of the conveyor 27 and each compartment 24 of the reservoir 9*a* can store a substantial supply of neighboring bundles 5. FIG. 4 shows the uppermost compartment 24 in appropriate position for the transfer of its contents onto the chute 45 for delivery into the range of a receiving means such as the singularizing device 17 of FIG. 1 or 2. The compartments 24 slope downwardly in a direction toward the chute 45 and their lowermost portions are adjacent to a stationary guide wall or barrier 25 having an opening or outlet 26 in register with the upper end of the chute 45. Thus, as soon as a bundle-containing compartment 24 is moved to a position in which its lower end registers with the opening 26 of the barrier 25, the bundles 5 can leave such compartment by gravity and continue to descend by gravity along the upper side of the chute 45 toward the receiving means. The conveyor 27 can be actuated in automatic response to signals from a device which monitors the supply of bristles in the magazine or magazines of the brush making machine which is not shown in FIGS. 4 and 5. FIG. 5 shows the reservoir 9*a* in its upper end position in which the lowermost compartment 24 is in register with the opening 26 of the barrier 25.

The reservoir 9*a* of FIGS. 4 and 5 can be designed to receive one or more pallets 9, otherwise configurated pallets and/or other types of substantially or preferably plate-like supports for groups or arrays of bundles 5. For example, each freshly emptied compartment 24 can be relieved of its pallet or pallets and the removed pallet or pallets can be replaced with one or more loaded pallets so that the reservoir 9*a* invariably contains an adequate supply of bundles 5. The pallets can be introduced into and removed from the compartments 24 by hand or by an automatic or semiautomatic feeding system of any suitable design. The arrow Pfl denotes in FIG. 4 one of the directions in which the reservoir 9*a* can be moved by the conveyor 27. The latter can be replaced with a rack and pinion drive or with any other suitable means for moving selected compartments 24 to the level of the opening 26 in the barrier 25. The compartments 24 can be moved into register with the opening 26 in a predetermined sequence or at random. The apparatus of FIGS. 4 and 5 is particularly useful in plants where the floor space is at a premium so that the bundles 5 must be stacked above rather than next to each other. Two or more reservoirs can be provided so that one thereof feeds bundles 5 to the receiving means by way of a first chute 45 while the other reservoir or reservoirs 9*a* are being refilled. In such apparatus, each of the reservoirs 9*a* is preferably associated with a discrete chute even though it is equally possible to mount two or more reservoirs for movement adjacent to the upper end of the chute 45 which is shown in FIGS. 4 and 5.

Figure 8:
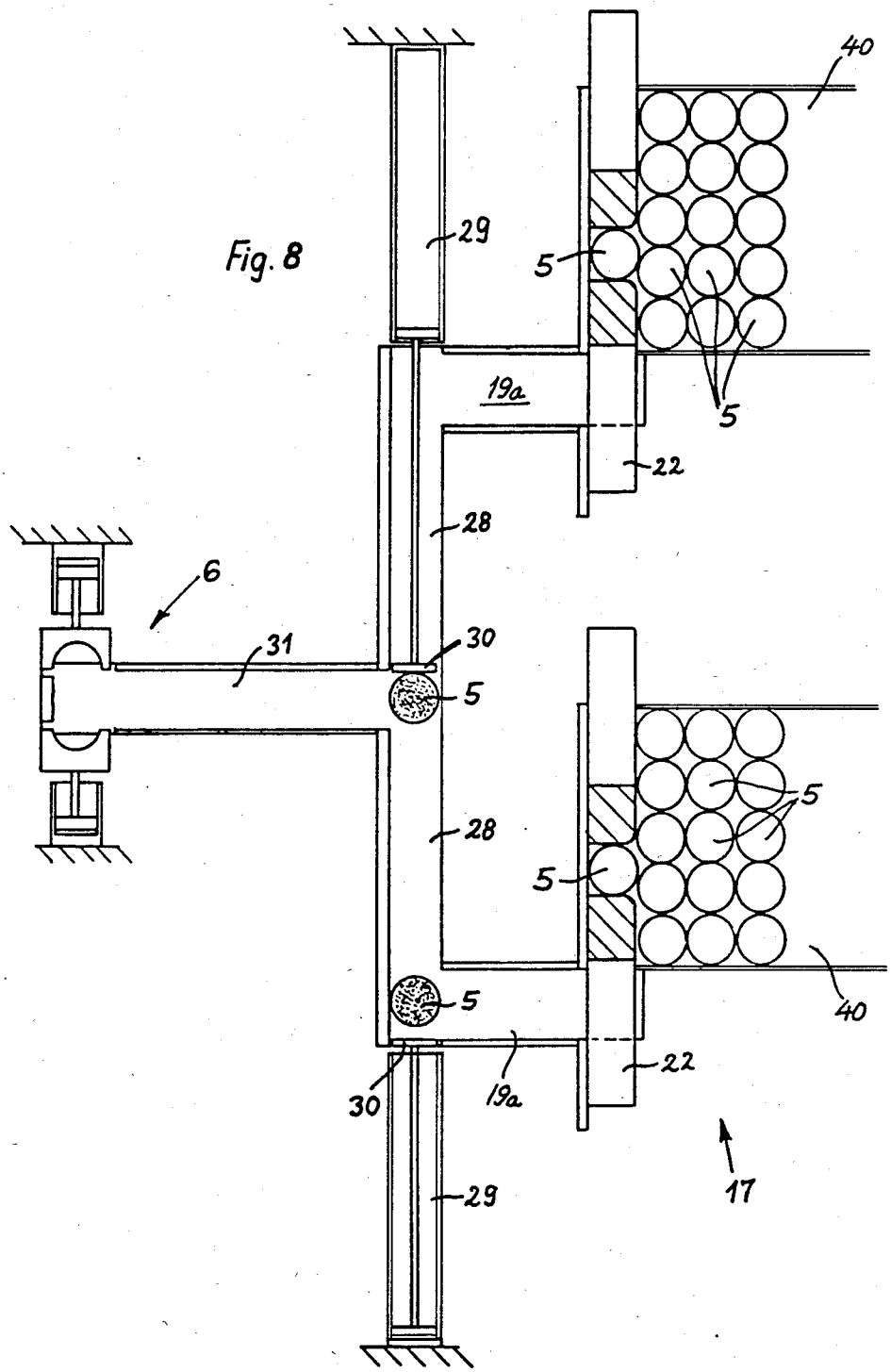
FIG. 8 is a schematic partially plan and partially horizontal sectional view of a fourth apparatus with two supports of the type shown in FIG. 1.

FIG. 8 shows a further apparatus wherein the source comprises two supports or two sets of supports, e.g., two supports 40 of the type shown in FIG. 1. Each of these supports is adjacent to a discrete receiving means in the form of a singularizing device 17 having a reciprocable singularizing member 22 with a pocket which can receive one bundle 5 at a time. The pockets can deliver discrete bundles 5 onto the upper ends of chutes 19*a* which, in turn, deliver such bundles in front of pushers 30 forming part of motors 29 designed to advance bundles 5 to the upper end of a further chute 31 constituting a means for advancing bundles 5 to the opening station 6. For example, the bundles 5 on the upper support 40 of FIG. 8 can contain bristles of a first type and the lower support 40 of FIG. 8 can support bundles 5 which contain bristles of a different second type. The instrumentalities at the opening or unwrapping station 6 can deliver exposed batches of both types of bristles to a single magazine or to two discrete magazines such as those shown at 7 and 7*a* in FIG. 11. The reference characters 28 denote channels or otherwise configurated guide means for the bundles 5 which are being advanced by the respective pushers 30 toward the upper end of the chute 31. The latter can be replaced with a suitable driven conveyor.

Figure 11:
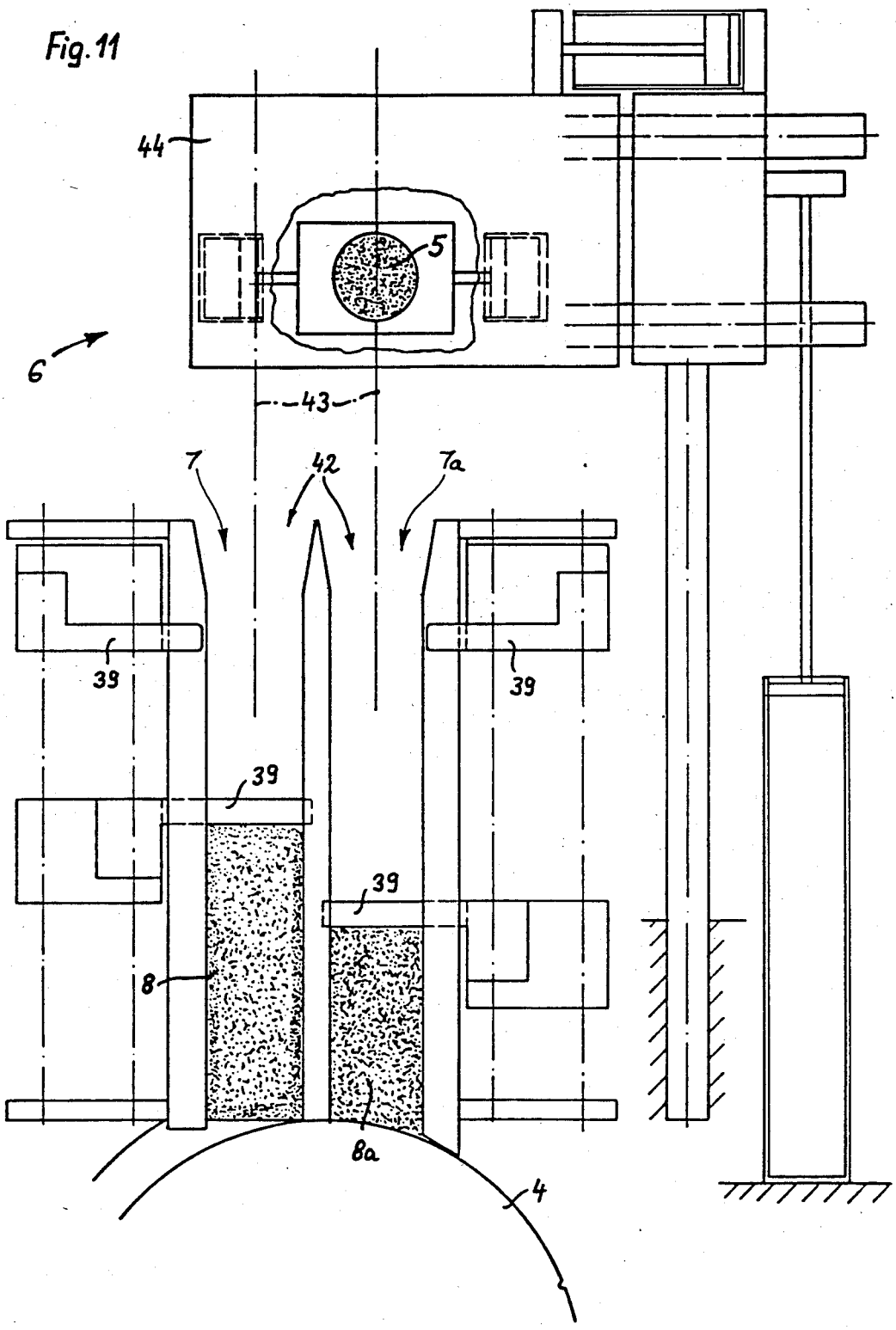
FIG. 11 is a schematic plan view of a portion of a brush making machine with two magazines which can utilize the apparatus of FIG. 8.

The brush making machine which embodies the structure of FIG. 11 has a partition which is disposed between the two magazines 7, 7*a* for bristles 8 (first type) and 8*a* (different second type). The reference character 44 denotes a shifting mechanism which can move the instrumentalities at the opening station 6 into register with the inlet 42 of the magazine 7 or 7*a*. The paths along which the bristles 8 and 8*a* are transferred from the opening station 6 into the respective magazines 7 and 7*a* are denoted by two phantom lines 43. For example, the magazine 7 can store a supply of bristles 8 having a first color and the magazine 7*a* can store a supply of bristles 8*a* having a different second color. It is clear that the magazines 7 and 7*a* can also serve to store bristles which are made of different materials or which have different diameters or other characteristics.

Figure 12:
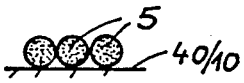
FIG. 12 is a fragmentary sectional view of a support and of a cylindrical bundle thereon which is supported in such position that its axis is parallel to the upper side of the support.

The structures which are shown in FIGS. 8 and 11 are identical with those shown in FIGS. 12 and 11 of the copending patent application Ser. No. 672,100. The characters 39 denote in FIG. 11 the aforementioned tamping members which ensure that the bristles 8 and 8*a* are stored in optimum condition for the formation of satisfactory tufts. FIG. 11 further shows a tuft forming and transferring member 4. This member can be used for evacuation of bristles 8 from the magazine 7 as well as for evacuation of bristles 8*a* from the magazine 7*a*.

However, it is also possible to provide a discrete transfer member for each of the two magazines.

Figure 9:
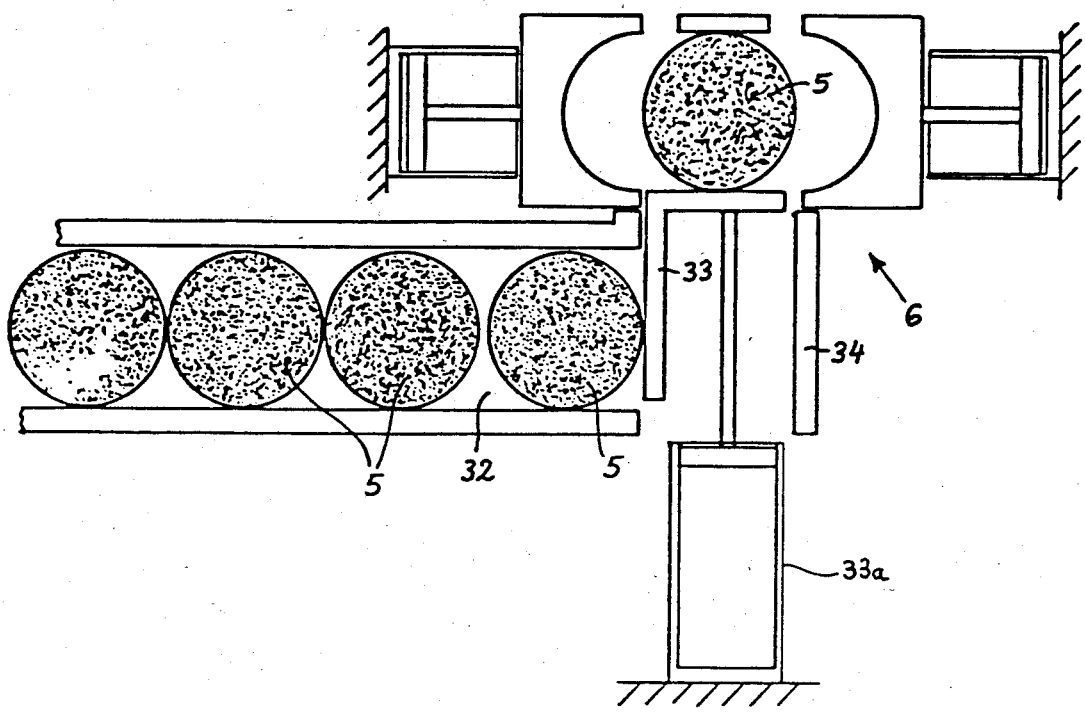
FIG. 9 is a plan view of a receiving means which can be used in the improved apparatus.

FIG. 9 shows a modified receiving means which is identical with the receiving means in FIG. 9 of the copending application Ser. No. 672,100. The reference character 32 denotes a chute which delivers a single file of bundles 5 toward the longer arm of an L-shaped gate 33 which is reciprocable by a fluid-operated motor 33*a* along a stationary stop 34. When the gate 33 is retracted (downwardly, as viewed in FIG. 9), it permits the foremost bundle 5 to leave the chute 32 and to advance toward and to come to rest adjacent the stop 34. The gate 33 is thereupon caused to perform a forward stroke toward the position which is shown in FIG. 9 whereby the just discussed bundle travels along the left-hand side of the stop 34 and enters the opening station 6 where it is relieved of its wrapper so that the bunch of bristles is exposed and is ready for admission into the magazine or into one of the magazines in the brush making machine. The chute 32 can be replaced with a channel which is bounded by two lateral walls serving to confine the bundles 5 therebetween to movement toward the gate 33 or stop 34. If the part 32 is not sufficiently inclined, it must cooperate with or must be replaced with a suitable driven conveyor (e.g., a belt or chain conveyor) which is capable of advancing the single file of bundles 5 toward the gate 33 and stop 34.

The details of the mechanism at the opening or unwrapping station 6 are shown in FIG. 10 which is identical with FIG. 1 of Ser. No. 672,100. The wrapper 38 of the bundle 5 which is delivered to the station 6 is engaged by two claws 36 which are reciprocable by fluid-operated motors and hold the wrapper against axial movement while a platform 36*a* for the bundle 5 is lifted by a motor 36*b* so that the batch of bristles in the bundle 5 that is held by the claws 36 rises with the platform 36*a* and relative to the wrapper 38. The thus exposed upper portion of the batch is engaged by two additional jaws or claws 37 which can move up and down as well as sideways and serve to extract the batch from the respective wrapper 38 as well as to deliver the thus fully exposed batch into the magazine 7 where the batch is thereupon engaged and entrained by one of the tamping members 39 and is merged into the rear portion of the supply of bristles 8 in the magazine 7. The manner in which empty wrappers 38 are removed from the opening station 6 is the same as disclosed in the application Ser. No. 672,100. For example, such wrappers can be expelled by jets of compressed air or they can be speared by pointed implements and removed from the space 35 above the platform 36*a*. As already mentioned above, the magazine 7 is preferably small (namely small in comparison with the requirements of a modern brush making machine) in order to ensure proper orientation of the bristles 8 therein and predictable advancement of bristles into the range of the transfer member 4. Moreover, a relatively small magazine renders it possible to subject the bristles therein to a predictable and uniform compacting action which is provided by the tamping members 39. The ability of the structure at the opening station 6 to unwrap the bristles in successive bundles is amply sufficient to replenish the supply of bristles in the magazine 7 at the rate which is required by the output of the brush making machine.

Figure 13:
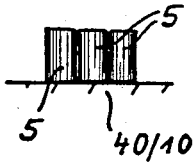
FIG. 13 is a similar fragmentary sectional view of a support which carries three bundles in upright position so that the axes of the bundles are normal to the upper side of the support.
Figure 14:
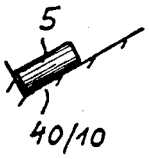
FIG. 14 is a fragmentary sectional view of an inclined support with a barrier which retains the bundles thereon against the force of gravity.

FIG. 12 shows that the bundles 5 can be placed onto a support 10 or 40 in such a way that their axes are parallel to the upper side of the support. This enables the bundles 5 to roll along their support. The manner of storing which is illustrated in FIG. 13 (with the axes of the bundles 5 extending at right angles to the plane of the upper side of the support 10 or 40) is preferred at this time because the support can carry a large number of bundles in a relatively small space and also because the movements of the bundles with reference to the support can be controlled with a higher degree of accuracy. FIG. 14 illustrates the manner in which the bundles 5 are or can be carried by an inclined support 10 or 40. Such support is then associated with or includes a barrier or stop which ensures that the stacked bundles 5 cannot slide beyond the lower end of the support. The bundle 5 which is shown in FIG. 14 can be placed onto the support in such a way (analogously to FIG. 12) that its axis is parallel to the upper side of the support or that such axis extends at right angles to the upper side of the support.

An important advantage of the improved apparatus is that it renders it possible to store large quantities of bristles 8 and/or 8*a* at a location which is close to or remote from the magazine or magazines of the brush making machine without necessitating the utilization of large or very large magazine or magazines. The bristles are stored in a state in which they are shielded from contamination and/or other undesirable influences because at least the major part of each batch is confined in a wrapper, and the bundles 5 can be rapidly, effectively and reliably relieved of their wrappers in a time saving manner and in devices which have been found to be highly effective for such purposes. Bristles which form part of bundles 5 can be manipulated much more readily than unwrapped batches of bristles, and a large number of bundles can be stacked or otherwise stored in a small area so that the accumulation of a supply which satisfies the requirements of a high-speed brush making machine during an entire shift or even for a longer interval of time presents no problems as far as the space requirements of the supply are concerned. The bundles 5 can be stacked or otherwise accumulated close to or at a reasonable distance from the magazine or magazines of the brush making machine, depending on the availability of space in the brush making plant. The conveyor means including one or more belt or chain conveyors, one or more chutes and/or one or more pushers can be automated to a desired extent and can be readily designed to advance the bundles along a straight path or along a more complex path.

It has been found that even a very small wrapper (the term wrapper is intended to embrace sheet-like wrapping material and/or cords, wires, bands and the like) suffices to facilitate the manipulation of bundles with much greater ease than the manipulation of batches of unwrapped bristles. The rate at which the stored bundles are relieved of their wrappers can be readily selected to conform to the requirements of the brush making machine to thus ensure that the machine can operate at maximum capacity or at any other rate which is selected by the operators.

A source which employs a set of pallets 10 or similar mobile supports in conjunction with one or more conveyors in the form of chains, belts and/or chutes has been found to be particularly suited to ensure the stacking of a large number of bundles in a small area or the stacking of a relatively small number of bundles but with the possibility of rapidly and conveniently replenishing the supply of stacked bundles whenever necessary. The utilization of supports in the form of pallets contributes to versatility of the improved apparatus and of the entire brush making machine. Moreover, the utilization of pallets which include covers or lids renders it unnecessary to temporarily store the bundles 5 in cartons, boxes or other types of receptacles because each pallet constitutes a receptacle which is capable of shielding the bundles from contamination and/or other adverse influences. The construction, dimensions and/or other characteristics of supports in the form of pallets or the like can be varied in a number of ways, as long as the supports can provide room for predictable storage of reasonable or large numbers of bundles in proper position for admission into the range of the receiving means ahead of the magazine or magazines of the brush making machine.

The aforementioned German Offenlegungsschrift No. 26 43 222 already discloses a direct connection between the inserting station and the station where sets of coherent bundles are subdivided into discrete bundles. A drawback of the proposal which is described in this German publication is that any, even minor, disturbances in the operation of the apparatus which subdivides longer bundles into bundles with bristles of requisite length practically immediately influence the output of the brush making machine, i.e., the machine must be brought to a halt in response to relatively short-lasting interruptions of the formation of bundles of ultimate length. Furthermore, the structure which is disclosed in the German printed publication is rather inflexible, especially as far as the positioning of the subdividing station with reference to the brush making station is concerned. On the other hand, the improved apparatus is surprisingly flexible, i.e., the means for subdividing longer bundles into shorter bundles and the means for storing shorter bundles can be placed at any desired distance from the magazine or magazines of the brush making machine and the bundles can be stored at the level of, above or below the magazine or magazines. Still further, the component parts of the improved apparatus are readily accessible for inspection, cleaning and/or repair, and such operations do not or need not directly influence the making of brushes, i.e., the operation of other parts or assemblies of the brush making machine. Still further, the improved apparatus is very flexible as concerns the replacement of one type of bristles with other types of bristles and/or simultaneous feeding of two or more different types of bristles.

If the apparatus is designed to deliver two or more different types of bristles to one and the same magazine or to two or more discrete magazines, the sequence in which the bristles of a particular type can be delivered to the corresponding magazine or magazines can be selected at will and can be automated to any desired degree. Conversion from delivery of a first type of bristles to delivery of a different second type of bristles takes up little time and requires a minimum of effort. All that is necessary is to exhaust or remove the supply of bundles on a stationary support or to replace detachable supports which carry bundled bristles of a first type with supports for bundled bristles of a different second type.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. In a brush making machine wherein bristles are confined in at least one magazine and the supply of bristles must be replenished at intervals by the admission of batches of arrayed bristles, apparatus for storing bundles of wrapped batches of bristles an for delivering such batches to the magazine, comprising a source of bundles including at least one support for maintaining a set of neighboring bundles in substantially upright positions; means for receiving bundles from said source, including a singularizing device arranged to accept discrete bundles from said source; and means for unwrapping the batches of bristles between said singularizing device and said magazine.

2. The apparatus of claim 1 in a brush making machine having a plurality of magazines, wherein said source has several outlets for bundles, one for each of said magazines, and said receiving means includes a discrete receiving unit for each of said magazines, each of said receiving units being arranged to receive discrete bundles from the respective outlet of said source.

3. The apparatus of claim 1, wherein said support includes means for carrying a set of several adjacent rows of neighboring bundles.

4. The apparatus of claim 1, wherein said source includes a plurality of supports and each of said supports includes a pallet, said source further comprising conveyor means for transporting successive pallets of said plurality to a predetermined position in the range of said receiving means.

5. The apparatus of claim 4, wherein each of said pallets comprises a bundle-supporting bottom panel and sidewalls extending upwardly from said bottom panel and defining at least one opening for evacuation of bundles which rest on said bottom panel.

6. The apparatus of claim 4, wherein said pallets are separable from said conveyor means.

7. The apparatus of claim 4, wherein each of said pallets includes a first section including a bottom panel for a group of bundles and a second section including a cover overlying the bundles on said bottom panel.

8. The apparatus of claim 7, wherein each of said first sections further comprises sidewalls extending upwardly from the respective bottom panel and said second sections have sidewalls overlying the sidewalls of the respective first sections.

9. The apparatus of claim 1, wherein said source comprises a plurality of supports and further comprising a chute for delivery of successive bundles from successive supports into the range of said receiving means.

10. The apparatus of claim 1, wherein said source further comprises a chute arranged to deliver bundles from said support into the range of said receiving means.

11. The apparatus of claim 1, wherein said source comprises a plurality of supports and endless belt or chain conveyor means for delivery of successive supports of said plurality into the range of said receiving means.

12. The apparatus of claim 11, wherein said source further comprises a chute arranged to deliver bundles from the supports on said conveyor means to said receiving means.

13. The apparatus of claim 12, wherein said conveyor means defines an elongated first path and said chute defines a second path extending substantially transversely of said first path.

14. The apparatus of claim 1, wherein said source comprises a plurality of superimposed supports and means for moving said supports to a predetermined level into the range of said receiving means.

15. The apparatus of claim 14, wherein said supports in said source slope in a predetermined direction and each thereof has an outlet for evacuation of bundles.

16. The apparatus of claim 15, wherein said source further comprises a barrier adjacent to the path of movement of said supports and arranged to prevent the evacuation of bundles from the supports while such supports are in the process of advancing into the range of said receiving means.

17. The apparatus of claim 16, wherein said barrier includes a stationary wall with an opening in register with the opening of that support which is disposed in the range of said receiving means.

18. The apparatus of claim 17, further comprising means for transporting discrete bundles from said opening to said receiving means.

19. The apparatus of claim 18, wherein said transporting means comprises a chute.

20. The apparatus of claim 1, wherein said source includes a multi-storey reservoir each storey of which is arranged to accommodate at least one support, and means for raising and lowering said reservoir so that the supports in said storeys can be moved to a predetermined level in the range of said receiving means.

21. The apparatus of claim 1, further comprising means for delivering bundles to said support.

22. The apparatus of claim 21, further comprising means for subdividing relatively long bundles into shorter bundles and for admitting such shorter bundles into the range of said delivering means.

23. The apparatus of claim 1, wherein said singularizing device includes a reciprocable singularizing member with a pocket arranged to receive one bundle at a time and means for reciprocating said singularizing member along a predetermined path.

24. The apparatus of claim 1, wherein said source has several outlets for discrete bundles and said receiving means comprises a discrete bundle advancing unit for each of said outlets, and means for accepting bundles from said units.

25. The apparatus of claim 1, wherein each of the bundles is or resembles a cylinder with two flat ends and said support includes a panel supporting one end of each bundle thereon.

26. The apparatus of claim 25, wherein said panel is inclined and said support further includes a barrier adjacent to the lowermost part of said panel and arranged to constitute an abutment for the adjacent bundles on said panel.

* * * * *